US006646201B1

(12) United States Patent
Gretz

(10) Patent No.: US 6,646,201 B1
(45) **Date of Patent: *Nov. 11, 2003**

(54) PREPACKAGED MOUNTING ASSEMBLY

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/287,088

(22) Filed: Nov. 4, 2002

Related U.S. Application Data

(63) Continuation-in-part of application No. 10/012,584, filed on Nov. 7, 2001, now Pat. No. 6,509,524, and a continuation-in-part of application No. 10/107,571, filed on Oct. 22, 2001, which is a continuation-in-part of application No. 09/784,981, filed on Feb. 16, 2001, now Pat. No. 6,335,883.

(51) Int. Cl.[7] ..... H01H 9/02

(52) U.S. Cl. ..... 174/58; 174/50; 174/60; 174/135; 174/53; 220/3.3; 220/4.02

(58) Field of Search ..... 174/50, 58, 63, 174/17 R, 60, 135, 53; 220/3.3, 3.7, 3.8, 3.6, 4.02, 3.5; 439/535; 248/906

(56) References Cited

U.S. PATENT DOCUMENTS 5,646,371 A * 7/1997 Fabian ..... 174/58
5,693,909 A * 12/1997 McEwen ..... 174/58
5,762,223 A 6/1998 Kerr ..... 220/3.9
6,147,306 A * 11/2000 Wilkins ..... 174/58
6,323,424 B1 * 11/2001 He ..... 174/58
6,509,524 B1 * 1/2003 Gretz ..... 174/58 X

* cited by examiner

*Primary Examiner*—Dhiru R. Patel

(57) ABSTRACT

A prepackaged mounting assembly for securing a ceiling fan, light fixture, or similar device to an overhead beam. The prepackaged assembly securely holds all the hardware needed for attaching the mounting block to a beam, including fasteners and a junction box cover, without the need for an outer wrap or separate packaging for each separate mounting assembly. Several mounting assemblies can therefore be placed loosely in a large packaging container and stored and shipped without loss of the separate parts for each assembly. The L-shaped mounting assembly provides a significantly larger integral internal wiring cavity than those provided in prior art assemblies. The internal cavity includes a cover that is temporarily secured to the assembly for storage and shipment and may be removed and reinstalled after wiring connections are completed within the cavity. After being reinstalled on the mounting assembly, the cover protects the wiring connections within from application of sheet rock, spackle, paint, and other subsequent operations. After initial installation, removing the cover enables easy access to wiring connections without dropping the suspended fixture.

2 Claims, 8 Drawing Sheets

PREPACKAGED MOUNTING ASSEMBLY

This application is a continuation in part of application Ser. No. 10/012,584, filed Nov. 7, 2001 now U.S. Pat. No. 6,509,524 and a continuation-in-part of application Ser. No. 10/017,571 filed Oct. 22, 2001 still pending which is a continuation-in-part of application Ser. No. 09/784,981 filed on Feb. 16, 2001 now U.S. Pat. No. 6,335,883.

FIELD OF THE INVENTION

The present invention relates to mounting assemblies for securing a device, such as a ceiling fan, light fixture, or similar device to an overhead beam and particularly to an L-shaped mounting assembly that provides an integral internal cavity for completing and holding wire connections that is significantly larger than prior art devices. The internal cavity includes a cover that is temporarily secured to the assembly for storage and shipment and may be removed and reinstalled after wiring connections are completed within the cavity. After being reinstalled on the mounting assembly, the cover protects the wiring connections from application of sheet rock, spackling, and painting around the assembly. Fasteners are provided with and secured to the box during storage and shipment to provide the installer a prepackaged mounting assembly with all required hardware included. At the assembly site, the fasteners are easily repositioned and used to secure the mount assembly to an overhead support member and a fixture to the mount assembly.

BACKGROUND OF THE INVENTION

Mounting structures for ceiling-suspended electrical devices are sometimes sold as a prepackaged unit including fasteners and a protective cover. For example, U.S. Pat. No. 5,762,223 (hereinafter the '223 patent) provides an electrical junction box to be used when supporting a relatively heavy hanging load from a joist or beam at an installation site. In one embodiment, a pancake dish and electrical lead box are integrally joined as a unit for direct joist mounting or can be utilized with a bracket. Although the '223 patent adequately provides a mounting structure capable of supporting large dynamic and static loads, the internal volume of the electrical lead box is severely restricted thereby making it difficult to complete and comfortably fit wiring connections within the electrical lead box. In addition, the '223 patent provides a removable plastic cover that is held on the lower apron of the mounting assembly by a frictional fit and mounting screws that are secured to the mounting assembly by a frictional fit between semi-circular dependent posts and annular vertical bosses. Although held by a frictional fit, the removable cover and mounting screws can easily be jarred loose during shipment, making it necessary to wrap the mounting assembly or provide an outer package to hold the cover and mounting screws inside the assembly during storage and shipment.

Accordingly, to overcome deficiencies in prior art mounting structures, it will be a first object of the present invention to provide a mounting structure having a large cavity for wiring connections. A second object includes providing a mounting structure that is capable of being stored, shipped, and sold as a prepackaged unit with all covers and fasteners required for installation self-contained within the unit. The cover and fasteners will be held securely enough to permit storage, shipping, display and without the need for an outer wrap or separate packaging.

SUMMARY OF THE INVENTION

According to the present invention, there is provided a mounting assembly for securing a device, such as a ceiling fan, light fixture, or similar device to an overhead beam. The mounting assembly includes an L-shaped mounting box that is fitted against an overhead beam with two sides, perpendicular to each other, in contact with the beam. A large integral internal cavity is provided for wiring connections. A cover, provided for the internal wiring cavity, is temporarily secured to the assembly for storage and shipment. Fasteners, required for mounting the box to a beam and a fixture bracket to the box, are also temporarily secured to the L-shaped box for storage and shipment. The L-shaped mounting assembly therefore includes the L-shaped box with an integral wiring cavity, a cover for the cavity, and fasteners for use in installing the box. The mounting assembly may be stored, shipped, and sold as a self-contained unit, without the need for an outer wrap or separate packaging.

At the installation site, all required items for mounting the L-shaped box are included with the assembly. An initial mounting fastener is used to anchor the box to an overhead beam. The cover may then be removed and reinstalled after wiring connections are completed within the cavity. After being reinstalled on the mounting box, the cover protects the wiring connections from application of sheet rock, spackle, and paint around the fixture. Fixture mounting fasteners, provided with the mounting assembly, are then removed from temporary storage holsters and moved to the proper location to secure a bracket for a ceiling fan, overhead light, or similar device.

Other advantages of the present invention will become apparent by reading the attached description with reference to the attached drawings.

TABLE OF NOMENCLATURE

Figure 1:
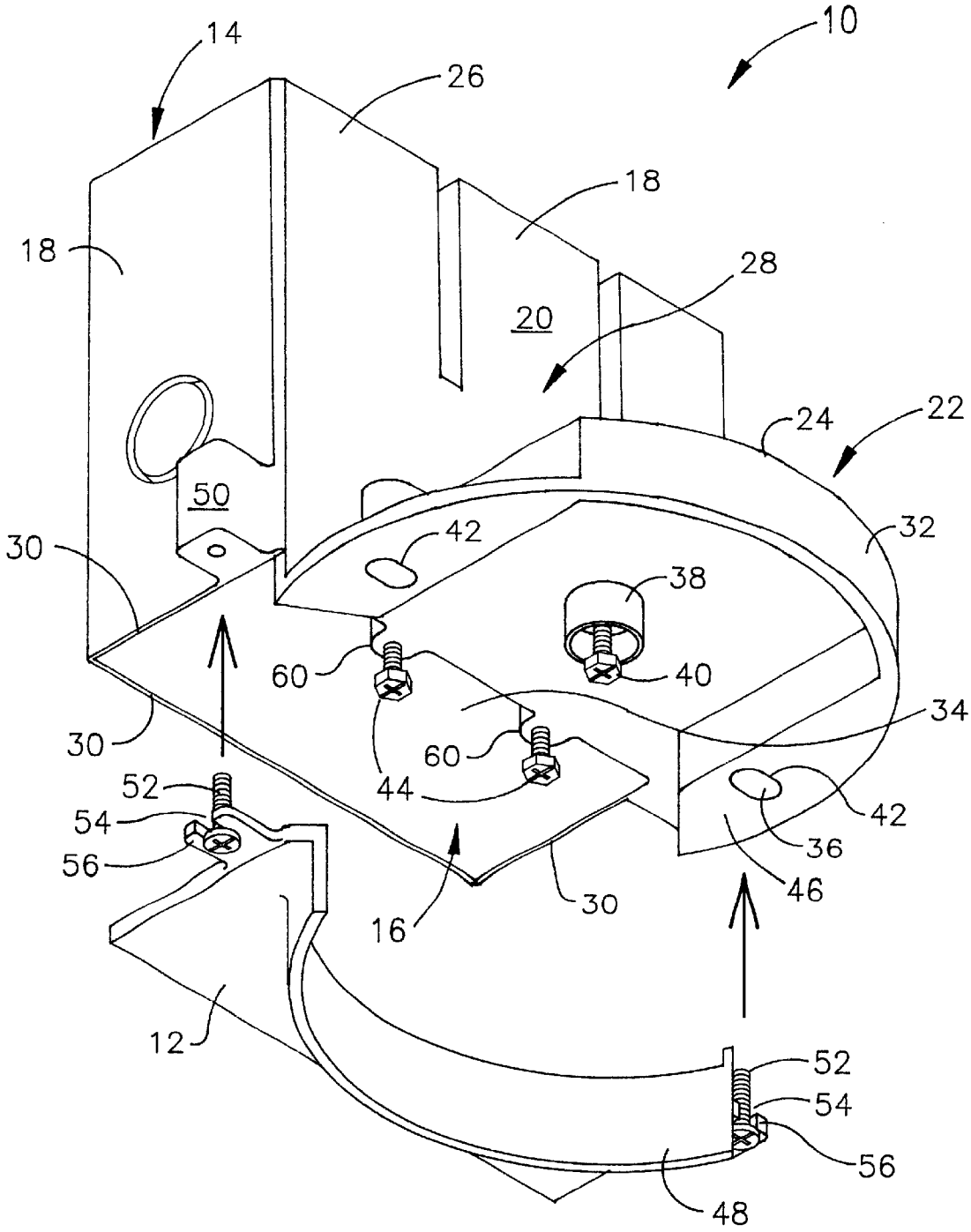
FIG. 1 is a perspective view of the mounting assembly with the cover exploded away from the mounting box.

The following is a listing of part numbers used in the drawings along with a brief description:

| Part Number | Description |
|---|---|
| 10 | prepackaged mounting assembly |
| 12 | cover |
| 14 | first junction box |
| 16 | internal wiring cavity |
| 18 | deep side walls |
| 20 | first side |
| 21 | inner wall (of first side) |
| 22 | second junction box |
| 24 | top of second junction box) |
| 26 | vertical face (of first side) |
| 28 | seat |
| 30 | edges (of three side walls) |
| 32 | shallow side walls |
| 34 | open area |
| 36 | apertures (in top) |
| 38 | boss (for initial mounting fastener) |
| 40 | initial mounting fastener |
| 42 | elongated slots |
| 44 | fixture bracket fastener |
| 46 | first arcuate flange (of second junction box) |
| 48 | second arcuate flange (of cover) |
| 50 | boss (to accept cover fastener) |
| 52 | cover fastener |
| 54 | aperture (in ear) |
| 56 | ear |
| 58 | circular mounting surface |
| 60 | holster |
| 62 | knockout |
| 64 | low profile connector |
| 66 | top (of first junction box) |
| 68 | top inner bore (of holster) |
| 68A | interior surface (of top inner bore) |
| 70 | bottom inner bore (of holster) |
| 70A | interior surface (of bottom inner bore) |
| 72 | point (of fixture bracket fastener) |
| 74 | support beam |
| 76 | side |
| 78 | side |
| 80 | hole |
| 82 | flat base |

DETAILED DESCRIPTION

A perspective view of a preferred embodiment of the present invention, a prepackaged mounting assembly 10 with the cover 12 detached, is shown in FIG. 1. The mounting assembly 10 includes a first junction box 14 with an internal wiring cavity 16, and deep side walls 18. Integral with and projecting orthogonally from a first side 20 of the first junction box 14 is a second junction box 22 in such a manner that the top 24 of the second junction box 22 and the vertical face 26 of the first side 20 form a seat 28 for fitting flush against a side and bottom of a beam or joist (not shown). The edges 30 of three side walls opposite the first side 20 end in a common lower plane. Shallow side walls 32 extend downward from the top 24 of the second junction box 22 on all sides away from the first junction box 14 leaving an open area 34 for the passage of wires (not shown) between the first 14 and second junction 22 boxes. Apertures 36 are included in the top 24 of the second junction box 22 for receiving fasteners for securing the mounting assembly to a beam or joist (not shown) including a boss 38 for receiving an initial mounting fastener 40 and elongated slots 42 for receiving fixture bracket fasteners 44. A first arcuate flange 46 is integral with and extends laterally from the shallow side walls 32 of the second junction box 22. A second arcuate flange 48 is integral with and extends downward from the cover 12. The side walls 18 of the first junction box 14 include bosses 50 (one shown) that will accept cover fasteners 52 that secure the cover 12 through apertures 54 in ears 56. After the cover 12 is attached by cover fasteners 52, the second arcuate flange 48 will mate with the first arcuate flange 46 of the second junction box 22 to form a circular mounting surface 58 that will accept a bracket (not shown) of a ceiling fan, light, or similar device. Provision is made for temporary storage of the fixture bracket fasteners 44 during shipment and storage by including integral holsters 60 molded along the inner wall of the first junction box 14 on the first side 20.

Figure 2:
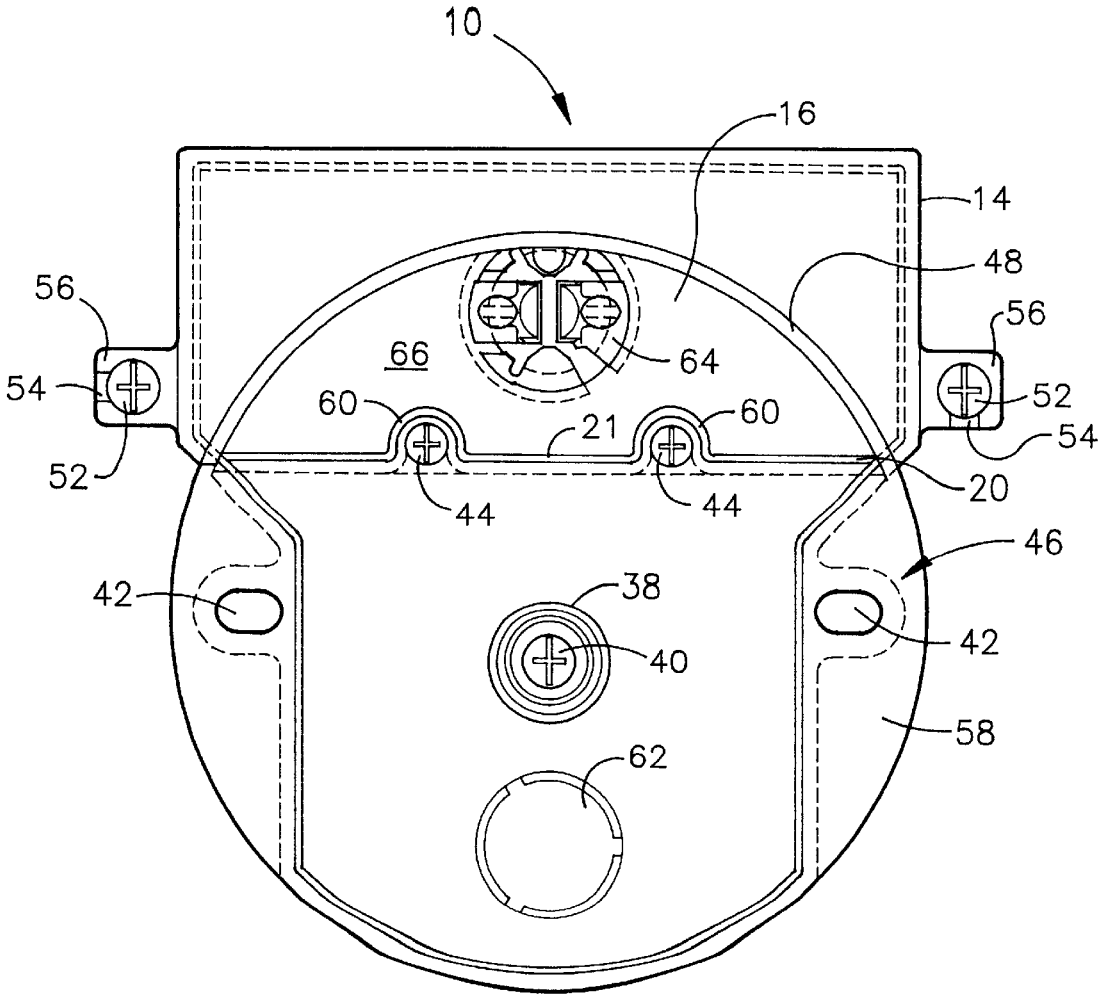
FIG. 2 is a bottom view of the mounting assembly of FIG. 1.

Referring to the bottom view of the mounting assembly 10 in FIG. 2, fixture bracket fasteners 44 are shown seated in their holsters 60 along the inner wall 21 of the first side 20 of the first junction box 14. The holsters 60 are integral with and project from the first side 20 into the internal wiring cavity 16. One advantage of the prepackaged mounting assembly 10 is its large wiring cavity 16, which becomes apparent when viewing FIG. 2. Prior art L-shaped mounting blocks are typically circular in shape with the junction box conforming to the circular limits of the bottom flange and thereby limiting the size of the wiring cavity. In the present invention, as shown in FIG. 2, the first junction box 14 extends beyond the circular mounting surface 58 created by the first 46 and second 48 arcuate flanges. Other details of the arrangement of the mounting assembly 10 shown in FIG. 2 include a knockout 62 in the second junction box 22, a low profile connector 64 located in the top 66 of the first junction box 14, elongated slots 42 through which the fixture bracket fasteners 44 will later be mounted, and cover fasteners 52 which will secure the cover 12 to the first junction box 14 through apertures 54 in ears 56. The initial mounting fastener 40 is shown seated in its boss 38 that is an integral extension from the second junction box 22.

Figure 3:
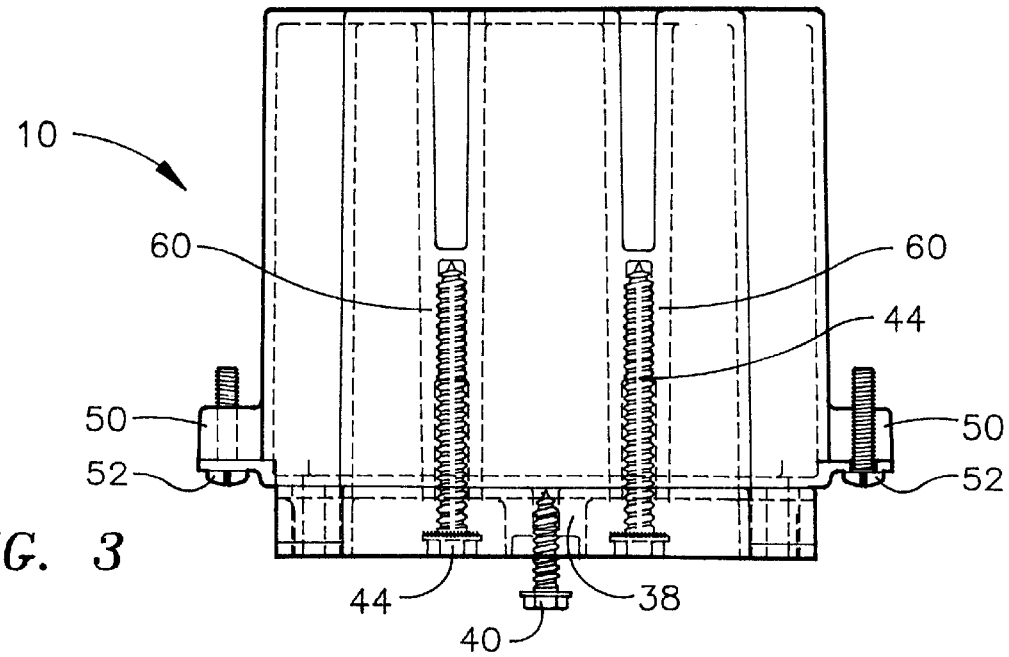
FIG. 3 is a side view of the mounting assembly of FIG. 1 in phantom lines and showing the relative location of the self-contained fasteners included with the assembly.

Referring to FIG. 3, a side view of the prepackaged mounting assembly 10 in phantom lines shows the relative location of the self-contained fasteners during shipment and storage including the cover fasteners 52 seated in their bosses 50, the initial mounting fastener 40 seated in its boss 38, and the fixture bracket fasteners 44 seated in the holsters 60. During installation of the box, the cover fasteners 52 and initial mounting fastener 40 will be used at their storage location but the fixture bracket fasteners 44 will be removed from their temporary storage position in the holsters 60 and secured to the supporting beam or joist (not shown) through the elongated slots 42 (not shown).

Figure 4:
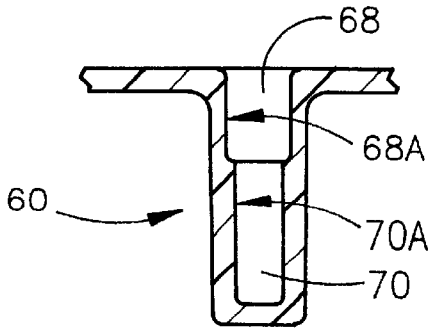
FIG. 4 is a side sectional view of an integral screw-retaining boss included with the mounting assembly of FIG. 1.
Figure 5:
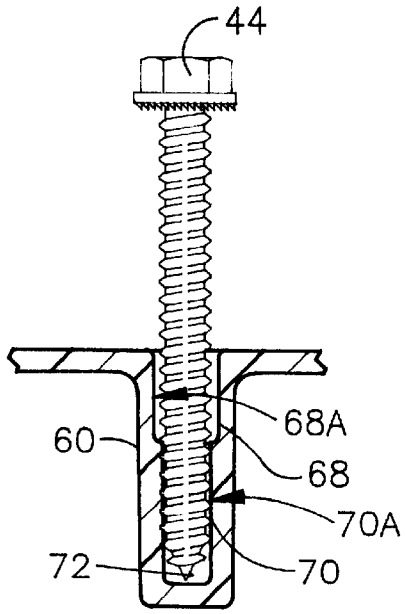
FIG. 5 is a side sectional view of the screw-retaining boss of FIG. 4 with a screw inserted partially in the boss.

Referring to FIG. 4, a side sectional view is shown of a screw-retaining holster 60 that will be used to hold a fixture mounting screw (not shown) for shipment with the electrical box to a job site. As used within this disclosure, a holster 60 is defined as an enclosure integral with a fixture mounting box for frictionally holding a threaded fastener so that it does not become separated from the box during storage and shipment, including a central bore open on at least one end for receipt of the threaded fastener and preferably closed on its second end for protecting the end of the threaded fastener. The central bore of the holster 60 includes a top inner bore 68 and a bottom inner bore 70 with the top inner bore 68 of a larger diameter than the bottom inner bore 70, as shown in FIG. 4. Top inner bore 68 includes interior wall 68A and bottom inner bore 70 includes interior wall 70A. Referring to FIG. 5, for use with a #12×2-inch sheet metal screw or fixture bracket fastener 44 the top inner bore 68 of the holster 60 typically measures 0.250 inch and the bottom inner bore 70 typically measures 0.187 inch. Preferably, the interior wall 68A of the top inner bore 68 and the interior wall 70A of the bottom inner bore 70 of each holster 60 is smooth. A smooth surface 68A on the top inner bore 68 enables the fixture bracket fastener 44 to easily slip into the holster 60 presenting no obstruction to the fastener 44 as it moves therein. A smooth surface 70A on the bottom inner bore 70 enables the fixture bracket fastener 44 to rapidly and easily self-tap and make its own thread. The combination of the smooth surface 68A and dimensions of the top inner bore 68 allows the fixture bracket fastener 44, with a nominal major thread diameter of 0.2115 inch, to enter the top inner bore 68 easily. The fixture bracket fastener 44 can then be screwed partially into the bottom inner bore 70, where it makes its own threads in the smooth surface 70A, and can be advanced until it is held securely for shipment. The fixture bracket fastener 44 can then easily be removed by an installer at the job site and repositioned to the proper location to secure a ceiling fan or other fixture to a rafter through one of the elongated slots (not shown in FIG. 5).

Figure 6:
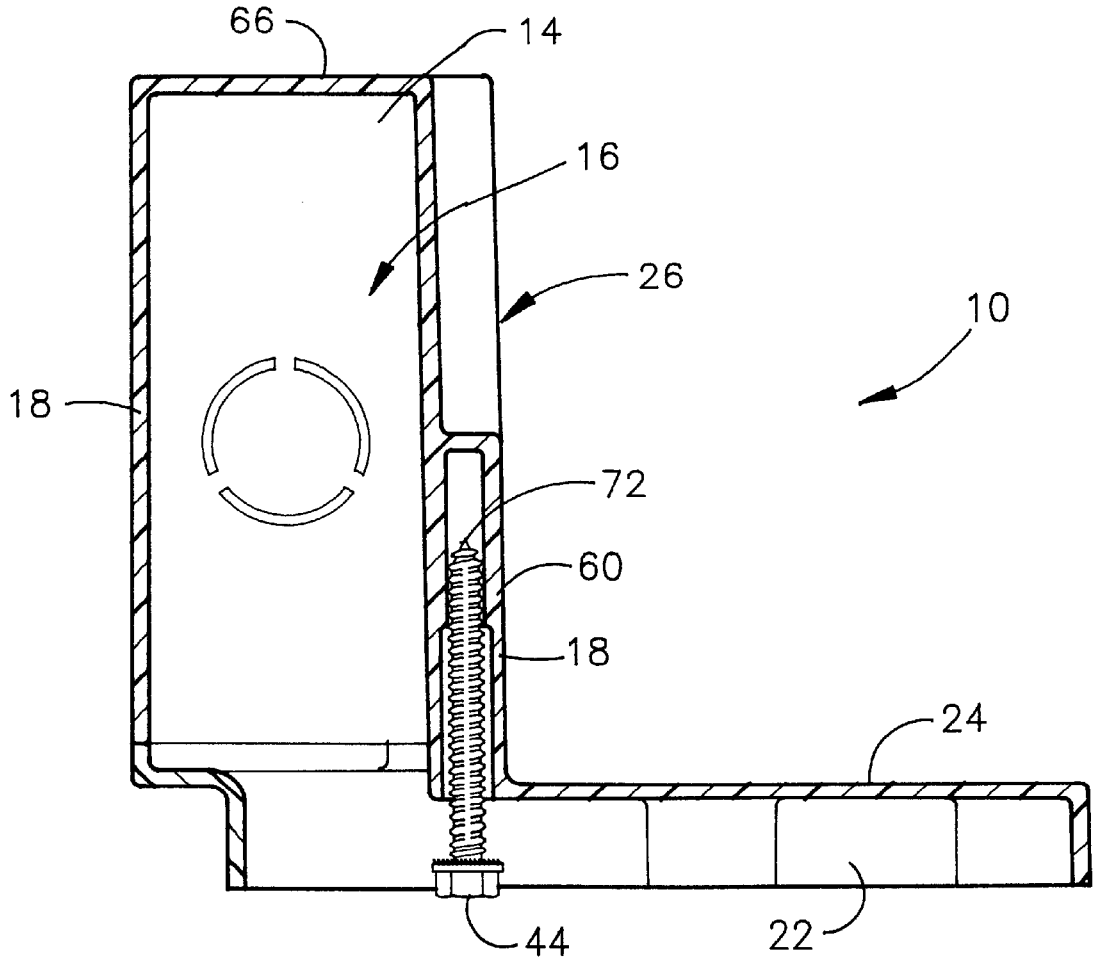
FIG. 6 is a side sectional view of the mounting assembly of FIG. 1.

As shown in FIG. 5, once inserted in the holster 60, the point 72 of the fixture bracket fastener 4 is enclosed within and protected by the holster 60. The holsters 60 therefore protect the ends or points 72 of the fixture bracket fasteners 44 during storage and shipment of the box. The prepackaged mounting assembly 10 of this disclosure may have relatively deep side walls 18 as shown in FIG. 6 or it may be manufactured with deeper or shallower side walls as desired for the specific application. When mounted within the holsters 60 for shipment and storage, essentially the entire length of the fixture bracket fastener 44 is recessed within and protected by the side walls 18 of the mounting assembly 10, as shown in the side sectional view of FIG. 6. The side walls 18 can be made deeper if preferred to provide more space for electrical connections or shallower if desired. For shallower boxes, the holsters 60 typically can extend from the top 66 of the first junction box 14 and accommodate the point 72 and essentially the entire length of the fixture bracket fastener 44.

The purpose and utility of the holsters 60 is to provide a location for the placement of fixture bracket fasteners 44 during shipment and prior to installation. The fixture bracket fasteners 44 may be screws, bolts, or similar fasteners. As is well recognized by those employed in the electrical trades, mounting bolts or screws for the attachment of ceiling fans or other electrical fixtures are often misplaced or left at a position remote from the installation site, for example on the floor, requiring time and effort to locate the screws or bolts or the acquisition of replacements to complete an installation. The inclusion of mounting bolts or screws, frictionally engaged in holsters 60 assures the immediate availability of such fasteners at the appropriate time in the installation process. Similarly, it is contemplated that the initial mounting fastener 40 that is used to initially fasten the mounting assembly 10 to a beam or joist (not shown) through screw-retaining boss 38 be similarly included by frictional engagement in boss 38 during shipping and prior to installation as shown in FIG. 1.

Figure 7:
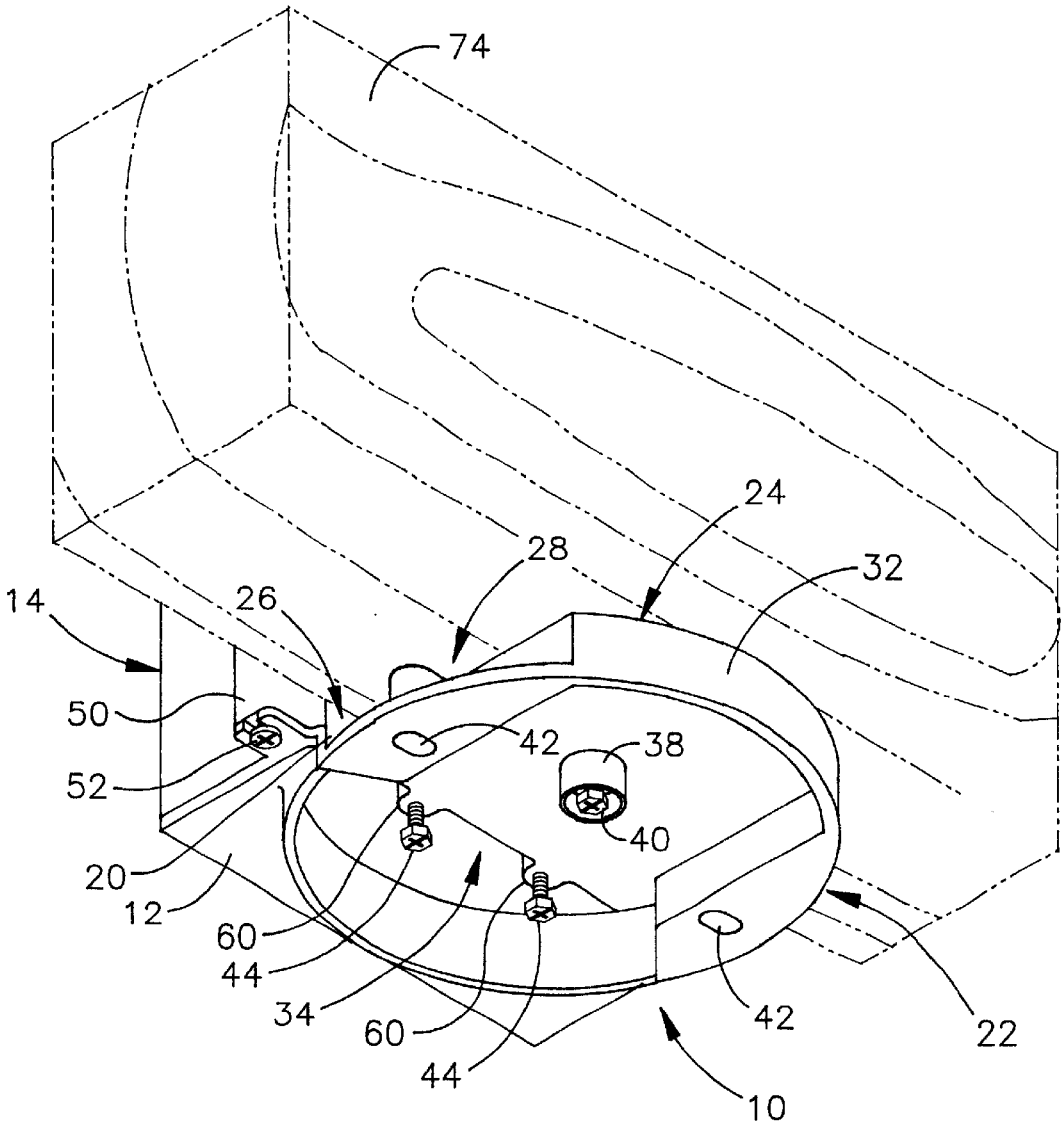
FIG. 7 is a perspective view of the mounting assembly of FIG. 1 after it has been initially mounted on a support beam by an initial mounting fastener and with the fixture bracket fasteners seated in their holsters.

Referring to FIG. 7, a preferred embodiment of the prepackaged mounting assembly 10 is depicted after it has been initially mounted on a support beam 74 by the initial mounting fastener 40. An installer typically receives the prepackaged mounting assembly 10 with the initial mounting fastener 40 secured in its boss 38, the fixture bracket fasteners 44 are secured in their holsters 60, and the cover fasteners 52 secured in their bosses 50 (one of which is in view in FIG. 7). To install the prepackaged mounting assembly 10, an installer typically first removes the initial mounting fastener 40 from its boss 38 and places the mounting assembly 10 against a support beam 74 with the seat 28, consisting of the vertical face 26 of the first side 20 and top 24 of the second junction box 22, flush against the beam 74, as shown in FIG. 7. The installer can then drill a hole in the beam 74 through the inner bore of boss 38 and secure the mounting assembly 10 to the beam 74 by tightening the initial mounting fastener 40 through its boss 38 into the beam 74. An installer would then drill pilot holes into the beam 74 through the two elongated slots 42 in the desired location to match the hole spacing in the fixture bracket (not shown). The fixture bracket fasteners 44 would then typically be removed one at a time from their holsters 60, one each placed through each of the fixture brackets (not shown) and tightened into the pilot holes at the elongated slots 42. The installer would next typically remove the cover 12 from the first junction box 14 and feed electrical cable from the house wiring system into the first junction box 14 through one of the available knockouts (not shown). The fixture would then typically be anchored to the bracket and the wiring leads from the fixture passed through the open area 34 from the second junction box 22 into the first junction box 14. Wiring connections can then be completed for the intended fixture by connecting house wiring to the fixture leads within the first junction box 14. The cover 12 can then be secured to the first junction box 14. If required for troubleshooting or repair, the cover 12 may easily be removed at anytime in the future to provide access to the wiring within the first junction box 14 without first dropping or removing the suspended fixture. This is an advantage over prior art L-shaped mounting assemblies. In prior art L-shaped boxes, the upright junction box is within the confines of the circular mounting surface, and access may be obtained to the wiring connections only by dropping or removing the fixture.

By providing a prepackaged mounting assembly 10, the installer avoids having to search for the proper fasteners for the job. The correct fasteners are available with the mounting block when required. Additionally, the required fasteners are held securely within the mounting block until needed, thereby allowing the distributor to package a number of prepackaged mounting assemblies in a shipping container. It is very common and desirable for distributors to package a large number of electrical devices loosely in a container as it eliminates outer wrap or packaging for each individual device making it easy for a contractor to purchase a container of prepackaged mounting assemblies and pull them out when needed. Since each individual device is loose in the shipping container, the contractor would not be inconvenienced with the task of removing outer wrap or individual packaging from each. Packing a number of the mounting assemblies loosely within a box is also attractive to the hardware superstores that prefer to place the opened containers on store shelves for easy access by store customers. Home owners benefit by having easy access to the prepackaged mounting assemblies and by not having to search for the proper fasteners.

Figure 8:
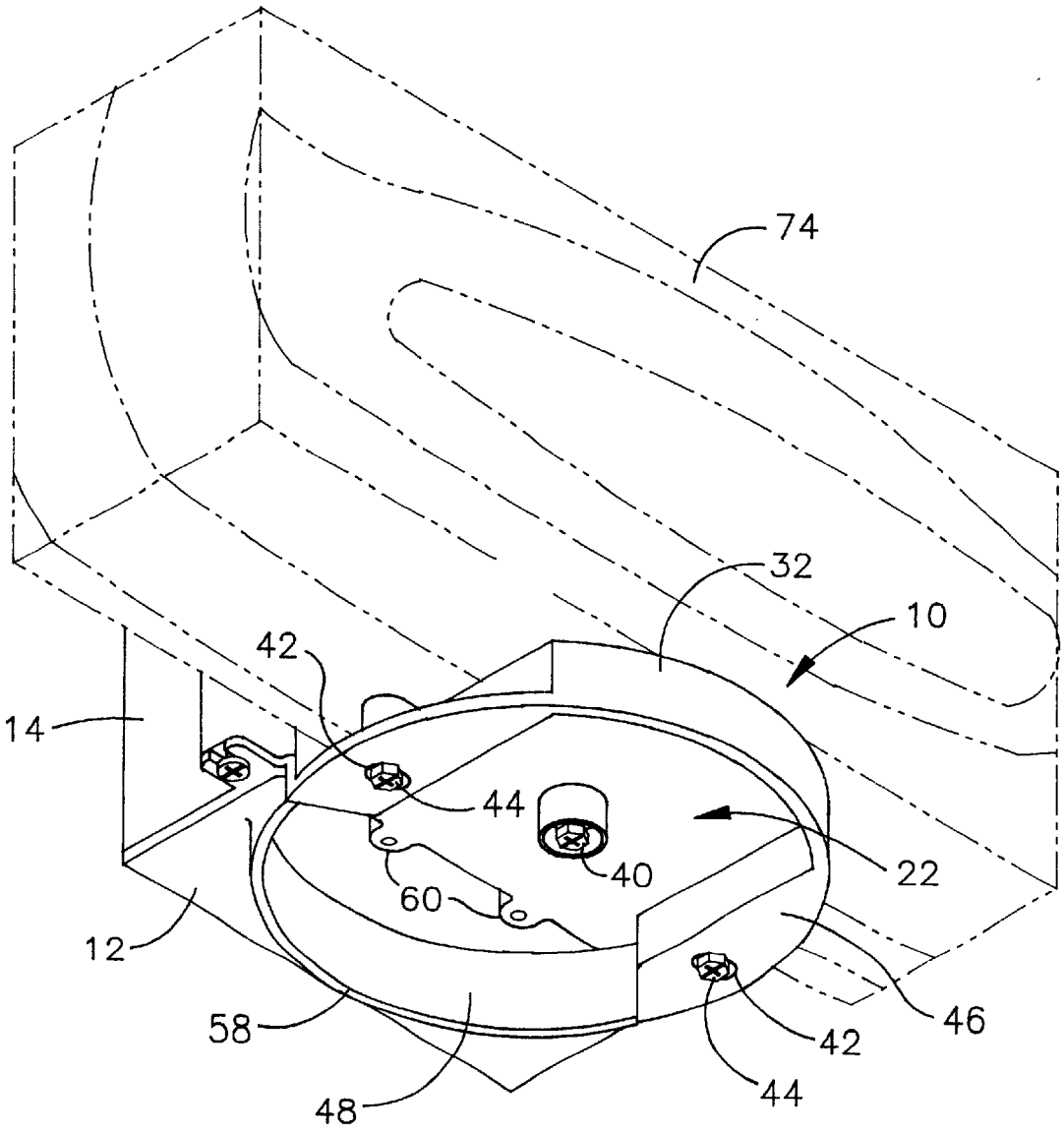
FIG. 8 is a perspective view of the mounting assembly of FIG. 1 after being completely secured to a support beam by both the initial mounting fastener and the fixture bracket fastener.

Referring to FIG. 8, a perspective view is shown of the mounting assembly 10 of FIG. 1 after being completely secured to a support beam 74 by both the initial mounting fastener 40 and the fixture bracket fasteners 44. A fixture bracket, normally supplied by the fixture manufacturer, would typically be fastened to the mounting assembly 10 by the fixture bracket fasteners 44, but is not included in FIG. 8 for clarity. As shown in FIG. 8 as compared to FIG. 7, the fixture bracket fasteners 44 have been moved from their temporary storage positions in the holsters 60 and mounted through the elongated slots 42 (edges visible only) where they both anchor the mounting assembly 10 and hold the fixture bracket (not shown) secure to the beam 74. As previously mentioned, the preferred fixture bracket fasteners 44 are typically #12×2" sheet metal screws, making the fixture bracket fasteners 44 the main anchoring means for supporting the static and dynamic loads created by a typical 70 to 100 pound ceiling fan or similar fixture. The initial mounting fastener 40 also assists in supporting the load and is preferably a #10×1" sheet metal screw.

As shown in FIG. 8, once the cover 12 is secured to the first junction box 14, it forms a portion of the circular mounting surface 58 to which a fixture bracket (not shown) will be secured. In prior art mounting assemblies, the mounting block typically has a circular profile with the upright junction box within the confines of the overall circular profile. The cover in prior art mounting assemblies is typically circular and covers the entire bottom portion of the mounting block, including the junction box. With prior art mounting assemblies, the frictional fitting cover must be removed and then retained while wiring connections are made within the junction box. The cover must then be placed upon the lower apron of the mounting block where it must be held by friction as sheet rock and then paint is applied. With the present invention, once wiring connections are completed and the cover 12 is secured to the first junction box 14, it is left in place and the second arcuate flange 48 on the cover 12 is obscured from view by the fixture (not shown) suspended below it. When the mounting assembly 10 is anchored to a joist, sheet rock may be applied around the mounting assembly 10 to completely obscure the cover 12 or it may be applied so as not to obscure the cover 12 and therefore keep the cover 12 accessible. By extending the first junction box 14 beyond the original confines of the circular mounting surface 58 and providing a cover 12 that covers only the first junction box 14, the internal wiring cavity provided by the present invention is much larger in volume than those of the prior art. A second advantage provided by a separate cover 12 for the first junction box 14 is that the internal wiring cavity 16 may be accessed after initial installation of the ceiling fixture without having to remove the fixture itself. Typically, if anchored to a joist, some sheet rock may have to be removed and replaced, but the fixture itself can remain secured to the first arcuate flange 46 on the second junction box 22. In prior art mounting assemblies, the junction box is confined within the circular perimeter of the mounting block, and therefore access to the wiring cavity is obtained only by removing the fixture from the mounting block.

As previously mentioned, one of the advantages of the mounting assembly of the present invention over the prior art is the large volume of the internal wiring cavity of the first junction box. Referring to FIG. 6, the typical dimensions of the internal wiring cavity 16 of a preferred embodiment of the prepackaged mounting assembly 10 of the present invention include a width, between the two side walls 18, of 1.7 inches, a length of 4.0 inches, and a depth of 3.2 inches. The internal wiring cavity 16 of the first junction box 14 therefore provides approximately 22 cubic inches of volume for wiring connections. This compares to an approximate 9.0 cubic inch volume for prior art L-shaped mounting assemblies.

Figure 10:
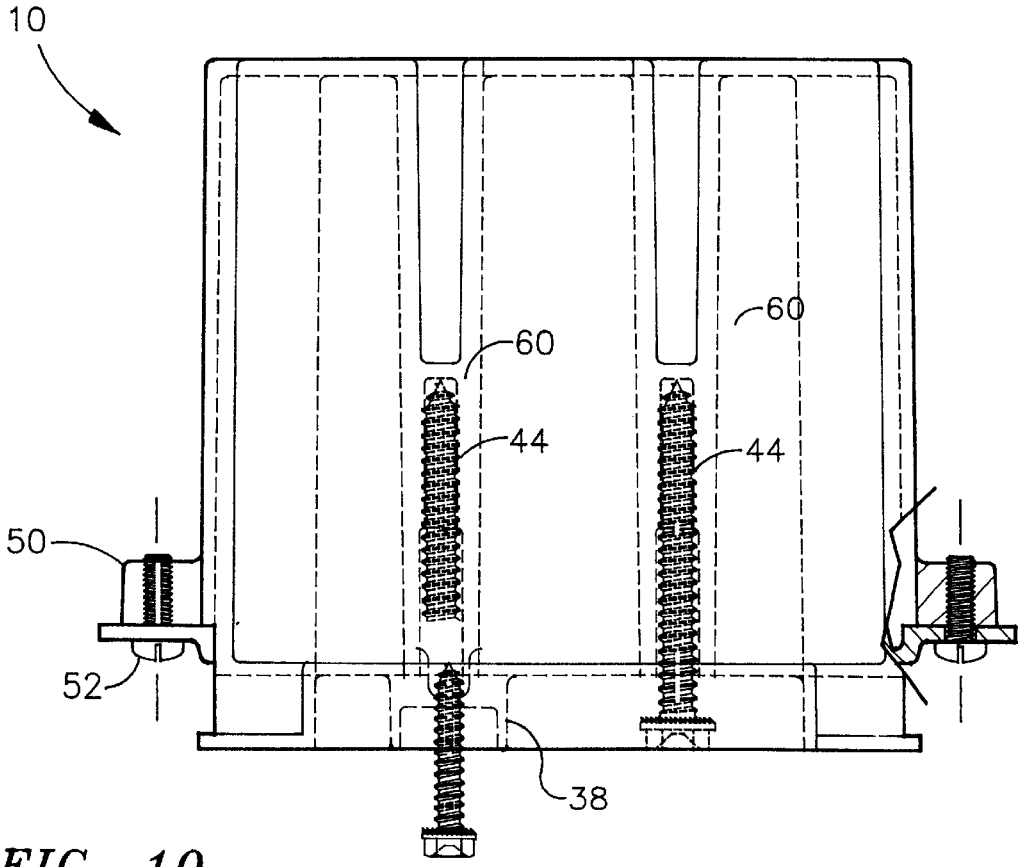
FIG. 10 is a side view of the mounting assembly of the alternate embodiment of FIG. 9, and showing the relative location of the self-contained fasteners included with the assembly.
Figure 9:
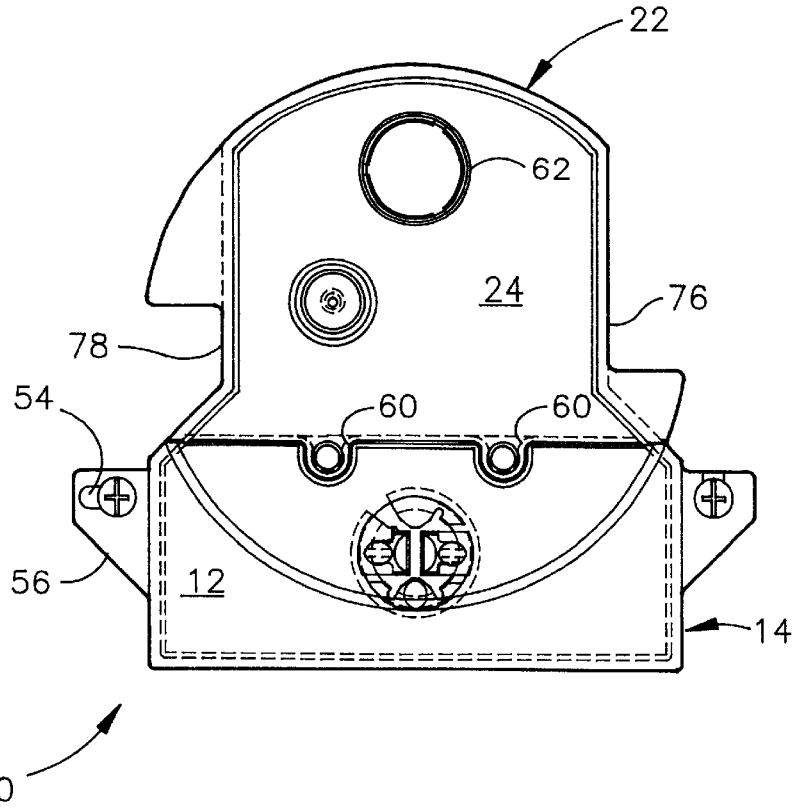
FIG. 9 is a top plan view of an alternate embodiment of subject invention.
Figure 11:
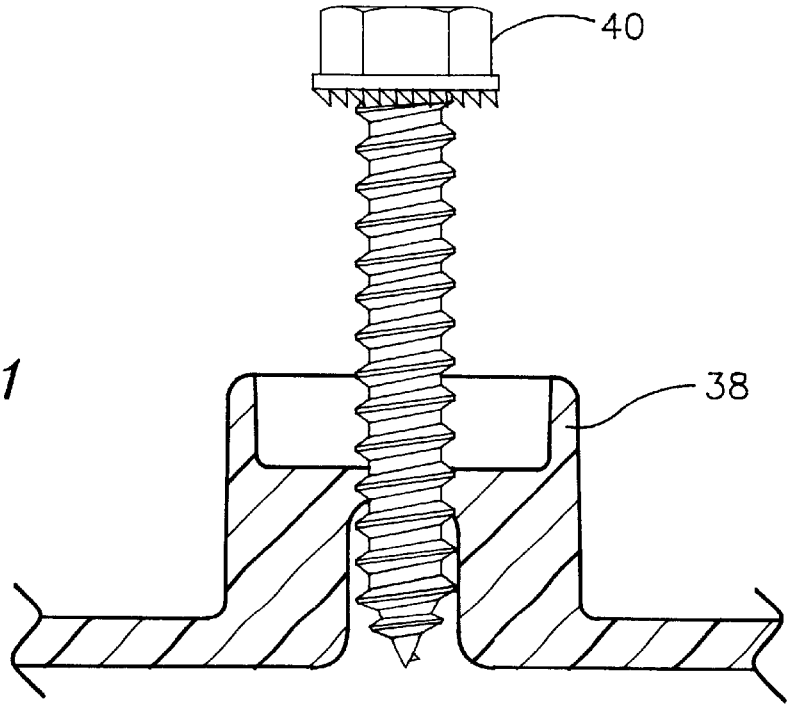
FIG. 11 is a boss detail including initial mounting fastener.
Figure 12:
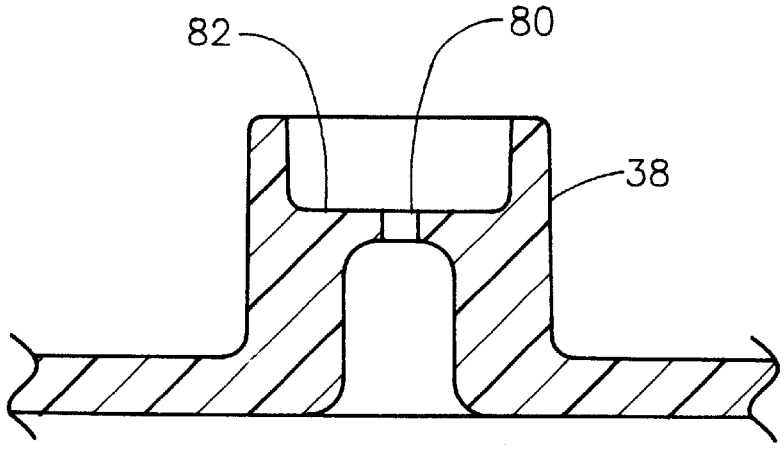
FIG. 12 is a boss detail of FIG. 11 without the initial mounting fastener.

With reference to FIGS. 9–12, showing an alternate embodiment of the invention which is to be preferred when there is no provision in the mounting assembly for openings or aperture in the mounting assembly for receipt of fixture bracket fasteners. There is shown a pre-packaged mounting assembly 10, a cover 12, a first junction box 14, and a second junction box 22. There is a top 24 for the section junction box. There is a boss 38 for the initial mounting fastener. It is to be noted that the fastener is only capable of holding the pre-packaged mounting assembly in position temporarily and is not designed to be able to support any substantial loading. There are no elongated slots 42 in this embodiment. Instead it has a side 76, and a side 78 of the section junction box 22. The width between 76 ad 78 defines the width of the second junction box. FIGS. 11 and 12 show the initial mounting fastener 40 located in the boss 38 of FIG. 11, and a hole 80 smaller than the diameter of the initial mounting fastener 40 in FIG. 12, so that it can be positively held in position for shipment and held in place when the pre-packaged mounting assembly is initially fastened to a joist or beam for temporarily holding the mounting assembly in position. The fastener 40 is held in position as it is screwed into the joist or beam, where it bottoms out on the flat surface 82 of the boss 38.

Fixture bracket fasteners 44 are shown in their shipping position in FIG. 10 with the leading portions of the screws or fasteners self-tapped into part of the holster 60. The mounting assembly is first placed in position and held there by initial mounting fastener 40. Then the bracket that comes from the manufacturer of a fan or the like is used and has openings at each end that are spaced apart a greater distance than the width of the space between sides 76 and 78. Then the two fixture bracket fasteners 44 are removed from their holsters and then are inserted in the openings in the bracket that has been supplied by others and the bracket is secured directly into the beam or joist. The openings in the bracket and the fixture bracket fasteners 44 are outside the width of the second junction box. This arrangement gives a greater adaptability of the pre-packaged mounting assembly to accommodate different brackets by not having the elongated slots 42 since there are no elongated slots in this embodiment. At the same time the two load-bearing fixture bracket fasteners are readily available for the installer from their holster for use in fastening the bracket directly to the beam or joist.

As the invention has been described, it will be apparent to those skilled in the art that the same may be varied in many ways without departing from the spirit and scope of the invention. Any and all such modifications are intended to included within the scope of the appended claims.

What is claimed is:

1. A prepackaged mounting assembly for use with a bracket separately supplied having openings comprising:

A) a first junction box having a first side and a vertical face on said first side;

B) a second junction box having a top integral with and projecting orthogonally from said first side of said first junction box such that said top of said second junction box and said vertical face of said first side form a seat for fitting flush against two sides of a beam or joist, said first junction box having deep side walls and said first side with the edges of said side walls opposite said first side ending in a common lower plane, said second junction box including shallow side walls on all sides away from said first junction box and an open side toward said first junction box having a width less than the width of said openings of said bracket;

C) a cover for mounting on said deep side walls of said first junction box;

D) a first arcuate flange integral with and extending from said shallow side walls of said second junction box; and E) a second arcuate flange projecting from said cover such that when said cover is attached to said first junction box, a lower edge of said second arcuate flange is coplanar with a lower edge of said first arcuate flange with said open side between said second junction box and said first junction box.

2. A prepackaged mounting assembly for use with a bracket separately supplied having spaced openings comprising:

A) a first junction box having a first side and a vertical face on said first side;

B) a second junction box having a top integral with and projecting orthogonally from said first side of said first junction box such that said top of said second junction box and the vertical face of said first side form a seat for fitting flush against two sides of a beam or joist, said first junction box having deep side walls and said first side with the edges of said side walls opposite said first side ending in a common lower plane, said second junction box including shallow side walls on all sides away from said first junction box and an open side toward said first junction box, said second junction box having a width less than the width of said spaced openings of said bracket;

C) a cover for mounting on said deep side walls of said first junction box;

D) a first arcuate flange integral with and extending from said shallow side walls of said second junction box;

E) a second arcuate flange projecting from said cover such that when said cover is attached to said first junction box, a lower edge of said second arcuate flange is coplanar with a lower edge of said first arcuate flange with said open side between said second junction box and said first junction box forming an open area for passage of wires from said second junction box to said first junction box;

F) load bearing threaded fasteners; and

G) holsters integral with said first side for temporary storage of said load bearing threaded fasteners, said holsters including tube-like receptacles for receipt of said threaded fasteners.

* * * * *

UNITED STATES PATENT AND TRADEMARK OFFICE

CERTIFICATE OF CORRECTION

PATENT NO. : 6,646,201 B1
DATED : November 11, 2003
INVENTOR(S) : Gretz, Thomas J.

It is certified that error appears in the above-identified patent and that said Letters Patent is hereby corrected as shown below:

Title page,
Item [63], the incorrect number for a Related U.S. Application is changed from "10/107,571" to -- 10/017,571 --.

Signed and Sealed this

Ninth Day of March, 2004

JON W. DUDAS
*Acting Director of the United States Patent and Trademark Office*